US005947176A

United States Patent [19]

Judkins

[11] Patent Number: 5,947,176

[45] Date of Patent: Sep. 7, 1999

[54] LENGTH ADJUSTABLE VENETIAN TYPE BLIND HAVING CLAMPS

[76] Inventor: Ren Judkins, 46 Newgate Rd., Pittsburgh, Pa. 15202

[21] Appl. No.: 09/106,033

[22] Filed: Jun. 26, 1998

[51] Int. Cl.[6] ..... E06B 9/30

[52] U.S. Cl. ..... 160/168.1 R; 160/178.1 R; 160/178.3 R

[58] Field of Search ..... 160/405, 168.1 R, 160/176.1 R, 178.1 R, 178.3 R, 173 R, 177 R; 29/24.5

[56] References Cited

U.S. PATENT DOCUMENTS

| | | | |
|---|---|---|---|
| 2,391,904 | 1/1946 | Junkunc | 160/178.1 R |
| 2,459,517 | 1/1949 | Gearhart | 160/168.1 R |
| 2,529,229 | 11/1950 | Sherwood | 160/168.1 R |
| 2,574,609 | 11/1951 | Appelbaum | 160/178.1 R |
| 2,652,112 | 9/1953 | Walker | 160/173 |
| 2,786,521 | 3/1957 | Evans | 160/178.3 R |
| 4,177,853 | 12/1979 | Anderson et al. | 160/168 R |
| 4,487,243 | 12/1984 | Debs | 160/176.1 R |
| 5,127,458 | 7/1992 | Schaefer et al. | 160/178.1 R |
| 5,205,335 | 4/1993 | Horton et al. | 160/115 |
| 5,285,838 | 2/1994 | Rapp et al. | 160/176.1 R |
| 5,562,140 | 10/1996 | Biba | 160/178.1 R |
| 5,573,051 | 11/1996 | Judkins | 160/168.2 |
| 5,655,590 | 8/1997 | Bryant | 160/168.1 R |
| 5,765,621 | 6/1998 | Bryant . | |

FOREIGN PATENT DOCUMENTS

| | | |
|---|---|---|
| 1 252 878 | 10/1967 | Germany . |
| 1 509 182 | 12/1968 | Germany . |

*Primary Examiner*—Blair M. Johnson
*Attorney, Agent, or Firm*—Buchanan Ingersoll, P.C.

[57] ABSTRACT

Clamps are provided for shortening a venetian type blind to fit windows of different lengths. The clamp has two portions connected by hinge. The two portions are fastened together on a lift cord and ladder below the slat at the desired shortened length. At least two clamps are used to shorten the blind. After the clamps are applied the blind is shortened by removing that portion of the blind below the clamps. This can be done by releasing each lift cord from the bottomrail and pulling the lift cord from the bottomrail through the slats to be removed. The excess slats are removed. Then the ladders are detached from the bottomrail, shortened and reattached to the bottomrail. The lift cords are then reconnected to the bottomrail and the clamps are removed. Alternatively, the clamps which grip the ladders and lift cords can be attached to the bottomrail.

10 Claims, 5 Drawing Sheets

LENGTH ADJUSTABLE VENETIAN TYPE BLIND HAVING CLAMPS

FIELD OF INVENTION

The invention relates generally to a venetian type blind, and more particularly to a venetian type blind having a length adjustable device for customizing the length of the blind to fit windows of different lengths.

BACKGROUND OF THE INVENTION

Venetian type blinds have a series of slats hung on ladder cords which extend from a headrail to a bottomrail. Depending upon the width of the blind, two or more lift cords are provided. Usually, each lift cord is attached at one end to the bottomrail. The lift cords pass through elongated holes in the slats up to and through the headrail. A cord lock is usually provided in the headrail through which the lift cords pass. The cord lock allows the user to maintain the blind in any desired position from fully raised to fully lowered. The slats rest on rungs between the rails of the ladder cords. The blind is in an open position when the rungs are horizontal. To close most venetian blinds one lifts one rail while allowing the other rail to either remain in place or be lowered. Both the lift cords and the ladder cords are typically nonadjustably connected to the bottomrail.

In U.S. Pat. No. 5,573,051, there is shown a venetian type blind having slats that are notched to form slots on their inside edge and outside edge to accommodate the lift cords. The lift cords pass from the bottomrail to the headrail each passing through a slot on the inside edge or outside edge of each slat. At least two cord-type ladders are provided to hold the slats and are aligned such that the rails of the ladders are adjacent the lift cords and outside the slots cut in the slats. The slots are sized so that the lift cords and the ends of the rungs can loosely fit therein. Because lift cords travel within the slots provided in the slats no cord holes are needed in the slats.

It is known to customize venetian type blinds to fit windows of different sizes. Generally, a standard width blind which is closest to, but wider than, the window is selected to be modified. The headrail, bottomrail and slats are trimmed to fit the width of the window. To maintain symmetry, an equal amount is usually trimmed from each end of the slats. Since the length of the blind is adjustable by simply operating the lift cords, the length of the blind sometimes is not modified. Instead, a standard size blind which is nearest to, but longer than, the length of the window is chosen and the extra length is stacked on the bottomrail which rests on or near the window sill. However, this arrangement can be aesthetically unappealing and compromises the blinds closure when tilted. Equally unappealing is to simply remove the slats because the portion of the ladders which supported the removed slats would still remain. For the best appearance the blind should be nearly the same length as the window when fully extended. Any change in length must shorten the ladders and compactly stack or remove slats.

In venetian type blinds the rails of ladders, which typically are cords but could be tape, and the lift cords can be attached to the bottomrail in different ways. One manner of attaching a ladder tape to a bottomrail is shown in U.S. Pat. No. 2,652,112 to Walker wherein the lift cord passes through small openings in the middle of each slat. The bottomrail has a hole completely through the top and the bottom surfaces. The opening in the top surface of the bottomrail is slightly narrower than the opening in the bottom surface. The lift cord is inserted through the narrower opening and a knot is formed in the end so that it cannot be pulled back through the narrower opening. The rails of the tape ladder encompass the bottomrail. A channel is provided longitudinally along one side of the bottomrail into which a portion of the tape rail can be folded. A pin is then inserted into the longitudinal channel over the tape rail to frictionally hold the tape rail to the longitudinal channel.

Anderson et al. in U.S. Pat. No. 4,177,853 show a manner of connecting the lift cord and a ladder cord to the bottomrail. In Anderson, the bottomrail has a longitudinal channel provided along the upper surface and a hole provided in the lower surface for each lift cord. A plug is provided in each hole. Each lift cord passes through small openings in the center of each slat, through the longitudinal channel and is connected to a plug. The cord rails pass outside of and adjacent to each side of the bottomrail and are then inserted up through the hole in the lower surface. The cord rails are frictionally held in the opening by the plug. Similarly, to Anderson, German Patent Nos. 1 252 878 and 1 509 182 each disclose a manner of attaching a lift cord and ladder cords to a bottomrail wherein a longitudinal channel is provided in the upper surface of the bottomrail and a hole is provided in the lower surface. In each case the lift cord passes through small openings in the middle of each slat, through the longitudinal channel and attaches to the plug. The cord rails pass outside of and adjacent to each side of the bottomrail and are then inserted up through the hole in the lower surface. The plug frictionally retains the cord rails in the hole. In each case the plug is frictionally retained in the hole and/or is held therein because of the attachment to the lift cord.

Theoretically, the bottomrails described in Anderson and the two German patents could be adjusted for the length of the blinds by removing excess slats, removing the plug, cutting off the excess slack in the cord rails, reinserting the ends of the cord rails up through the hole in the underside of the bottomrail, and then reinserting the plug to hold the cord rails in place. However, one problem with such a procedure is that repeated removal and insertion of the plug results in the fit between the hole and the plug becoming looser such that the cord rails may not be securely held in the hole. Another is that it takes a significant amount of time for the novice.

Accordingly, there is a need for venetian blind having a bottomrail that is readily adjustable so that the blind can be easily customized to fit windows of different lengths. Such a blind should overcome the disadvantages in the prior art by eliminating the stack of excess slats on the bottomrail and the excess ladder portions. Such a blind should permit repeated disconnection and reconnection of the lift cords and ladders without loosening or otherwise deteriorating the connections.

SUMMARY OF THE INVENTION

I provide a venetian type blind having a bottomrail, headrail and plurality of slats hung on a cord-type ladders which extend between the headrail and bottomrail. The bottomrail is easily and quickly adjusted in length so that the blind can be customized to fit windows of different lengths. At least two clamps similar to a barrette are provided which can be attached to a lift cord or ladder. The length is adjusted by placing the clamps on the lift cords or ladders below the slat at the desired length. One option is to simply cut off the portions of the ladders and lift cords below the clamps without removing the excess slats or bottomrail. Another option is to shorten the lift cords and ladders. If the lift cords pass through route holes in the slats they are disconnected from the bottomrail and pulled through the extra slats. Then the extra slats are removed. If the lift cords pass through slots on the edge of the slats as in the no holes venetian blind of my U.S. Pat. No. 5,573,051 they need not be disconnected from the bottomrail before removing the extra slats. The clamp preferably is not removed from the ladders and lift cord after being clamped at the desired length. Rather, those clamps are attached to the bottomrail or the clamps form the bottom of the blind without a bottomrail. Alternatively, the clamps can be removed and the ladders and lift cords can be reattached to the bottomrail. If desired the extra portion of the ladders that contain excess slats can be cut away and discarded. Yet another option is to remove the slats from the ladders and store the excess ladder portions in the bottomrail.

Other objects and advantages of the present invention will become apparent from a description of the present preferred embodiments shown in the drawings.

DESCRIPTION OF THE PREFERRED EMBODIMENTS

Figure 1:
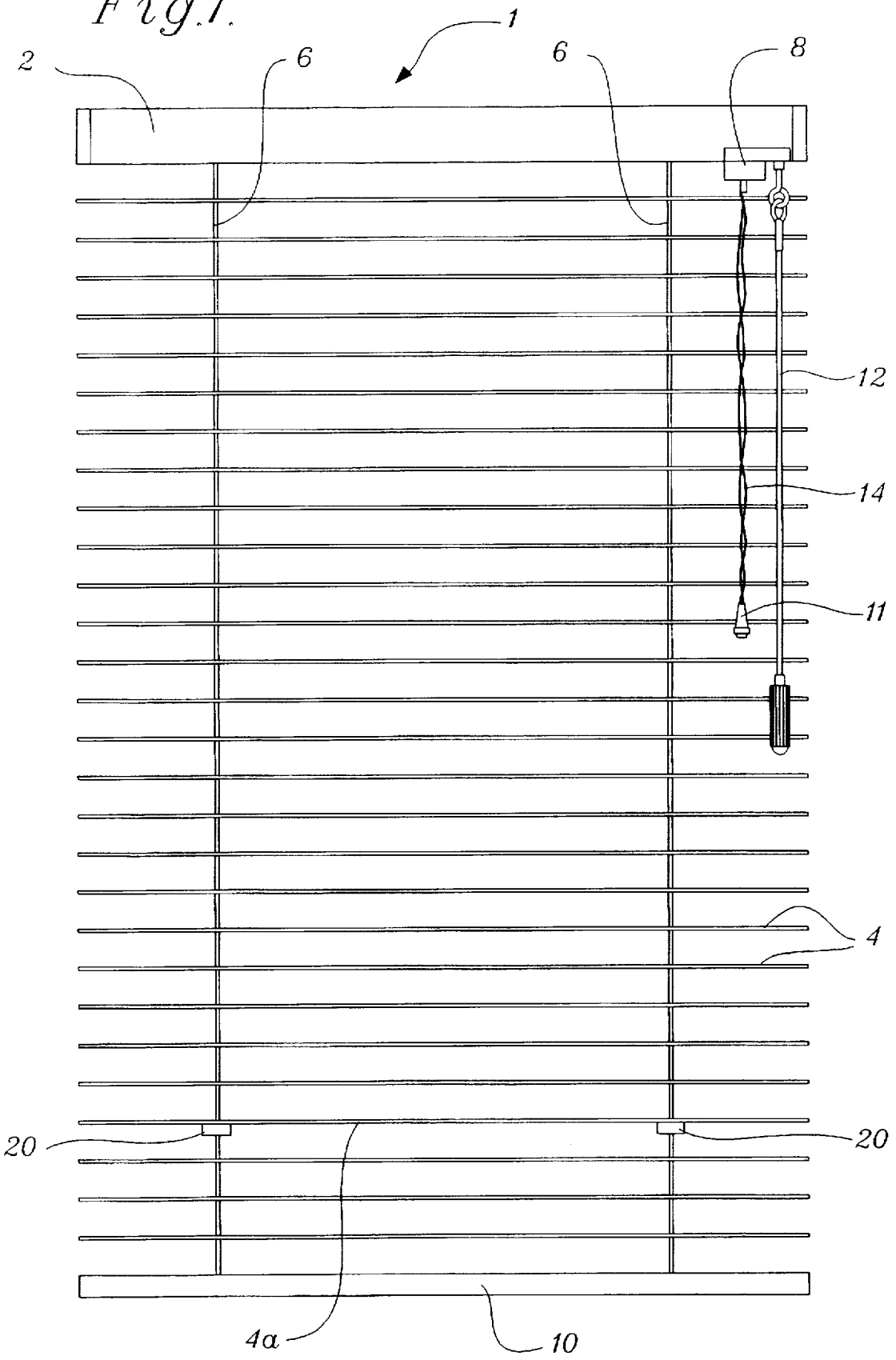
FIG. 1 is a front view of the present preferred embodiment of a venetian type blind shown in a lowered open position and having two clamps attached.
Figure 2:
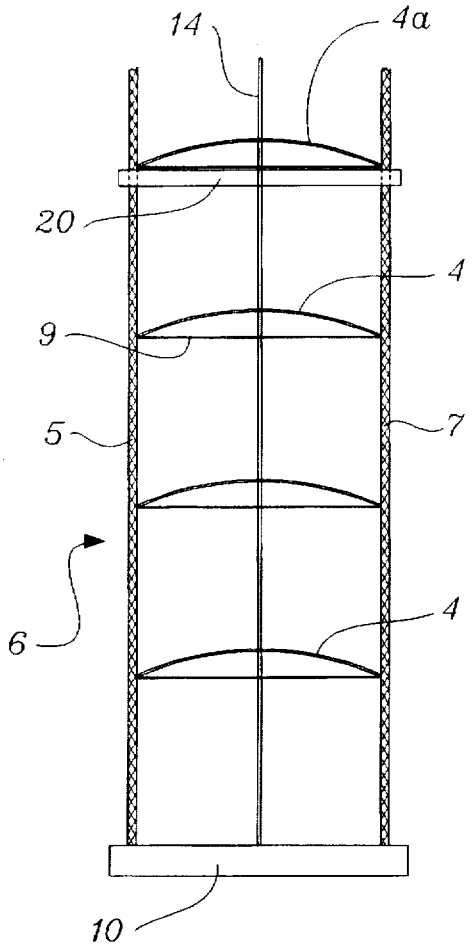
FIG. 2 is a side view of the lower portion of the blind shown in FIG. 1.

The first presently preferred embodiment of my venetian type blind 1 shown in FIG. 1 has a headrail 2, a length adjustable bottomrail 10 and a set of slats 4 extending therebetween. The blind 1 could have any number of slats and would likely have many more slats than are shown. As shown in FIG. 2, the slats 4 are suspended on cord-type ladders 6 having cord rails 5, 7 and rungs 9 extending between the cord rails 5, 7. Venetian blinds have at least two ladders and wider blinds often have three or more ladders. A tilt wand 12 is attached to a tilter (not shown) within the headrail that tilts the ladders 6 from the open position shown in FIG. 1 to a closed position. Lift cords 14 are attached to the bottomrail 10 and run through holes in the slats and into the headrail 2. The lift cords pass through a cord lock 8 in the headrail and terminate at tassel 11. In most common venetian blinds each lift cord passes through a route hole in each slat. The route holes can be in the center of the slats shown in FIG. 2 or close to one edge. The rails of the ladders can be attached to the bottomrail in any manner. Preferably this attachment permits easy release of the ladders so that the ladders can be readily shortened.

Figure 3:
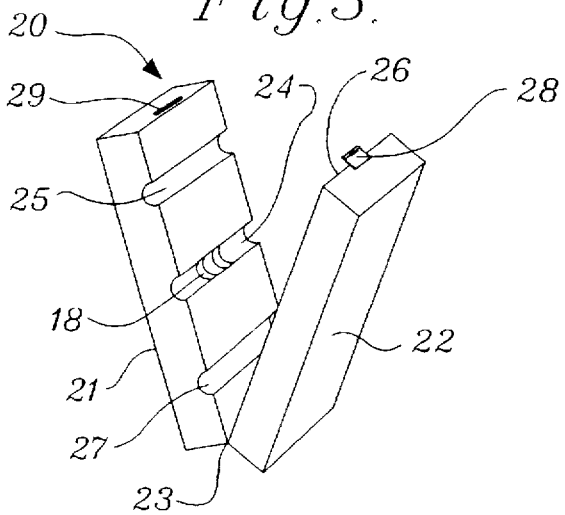
FIG. 3 is a perspective view of a first present preferred clamp device in a partially open position.
Figure 4:
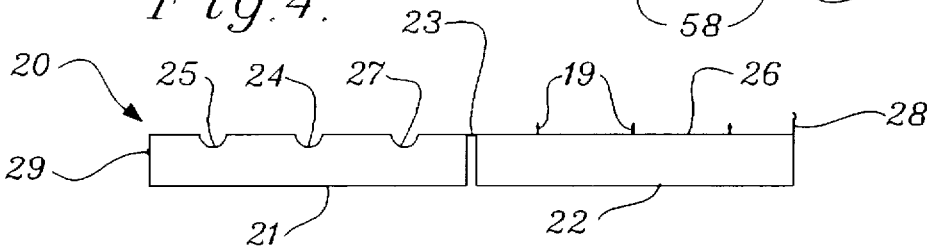
FIG. 4 is a side view of the clamp shown in FIG. 3 in a fully open position.

The blind can be shortened through use of clamps 20. At least two clamps 20 are attached to either the lift cord or the cord ladder to support the slat 4*a* at the location to which the blind will be shortened. A first preferred clamp is shown in FIGS. 3 and 4. That clamp 20 has a two piece body formed by halves 21 and 22 connected together by hinge 23. Preferably the clamp is a one piece molded plastic device having a living hinge, but the clamp could be a metal casting or stamping. I prefer to provide three slots 24, 25 and 27 in one of the body halves 21. Slot 24 is sized to receive lift cord 14. Slot 25 is positioned and sized to receive ladder rail 5. Slot 27 is sized and positioned to receive ladder rail 27. If desired the clamp could be made with only one slot 24 which grabs the lift cord or two slots 25 and 27 which engage the ladder rails. The clamp is placed on a ladder below the selected slat 4*a* so that the slots 24, 25, 27 align with the lift cord and ladder rails. Then the clamp is closed so that surface 26 of body portion 22 presses against the lift cord and ladder rails. If desired barbs 19 shown in FIG. 4 or ribs 18 shown in FIG. 3 can be provided on surface 26 or within slots 24, 25, 27 to penetrate or further compress the lift cord and ladder rails and provide stronger clamping. The barbs will prevent the weight of the slat or slats resting on the clamps from pushing the clamps off the lift cords and ladder rails. The body halves 21 and 22 are held together by a clasp 28 on body part 22 which engages a tab 29 on body part 21.

Figure 5:
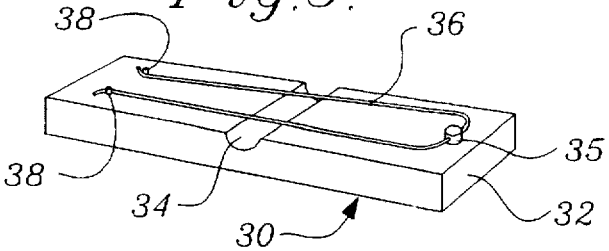
FIG. 5 is a perspective view of a second preferred clamp.

A second present preferred clamp 40 is shown in FIG. 5. This clamp looks very much like a hair barrette having an elongated body 32 with a slot 34 sized to receive a lift cord. A U-shaped wire portion 36 is secured at the base by a hub 35 on the body 32. Distal ends of the wire portion 36 are retained by posts 38. This clamp is secured to the lift cord by squeezing the distal ends of the wire portion 36 together and pulling them away from the main body 32. This will cause the wire portion 36 to pivot at hub 35. The body 32 is positioned so that the lift cord 14 is partially within slot 34. Then, the wire portion 36 is pivoted back toward the body portion 32 until the distal ends are secured by posts 38. Wire portion 36 will then clamp the lift cord in slot 34. If body 32 is wider than the width of the ladder 6, the ladder rungs 5 and 7 will also be secured against the body 32 by wire portion 36. If the body 32 is shorter than the width of the ladders the clamp will be secured only to the lift cord. If desired, the clamp shown in FIG. 5 may also have slots for the ladder rails like the embodiment of FIGS. 3 and 4. These slots could be provided in addition to or in place the slot 34 for the lift cord. Although it is possible to make either of the clamps 20 and 30 without any slots 24, 25, 27, 34, I prefer to have at least one slot in the clamp. I prefer to provide at least one slot to serve as a guide to the installer for positioning the clamp on the ladder. Rather than provide a slot in body 32, one can provide a curved portion comparable in size to the width of slot 34 in the wire portion.

Figure 6:
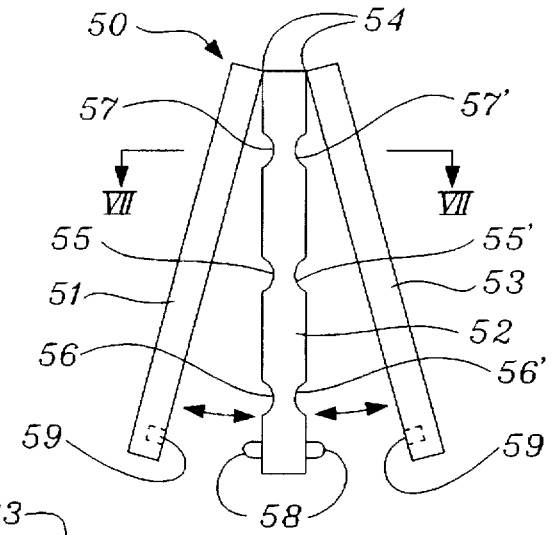
FIG. 6 is a top plan view of a third preferred clamp.
Figure 7:
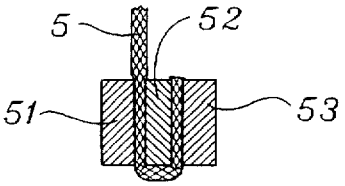
FIG. 7 is a sectional view taken along the line VII—VII in FIG. 6 after the clamp has been closed onto a ladder.

A third preferred clamp 50 shown in FIGS. 6 and 7 has three body parts 51, 52, 53 connected at one end by hinges 54. The center body part 52 preferably has slots 55, 55', 56, 56', 57 and 57' for the lift cord and ladder rails as in the embodiment of FIGS. 3 and 4. This clamp holds the ladder rails and lift cord between the left body part 51 and the center body part 52 as well as between the center body part 52 and the right body part 53. The three parts are held together by posts 58 on the center body part 52 that are positioned and configured to lock in holes 51 on the right and left body parts 51, 53. Alternatively, a clasp and tab like that in the embodiment shown in FIGS. 3 and 4 could be used.

Figure 8A:
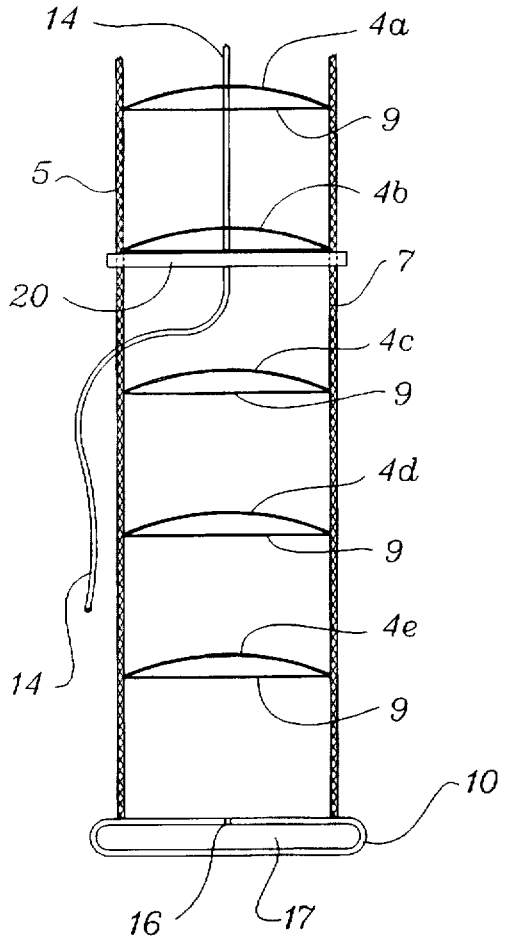
FIGS. 8*a* through 8*d* are end views of a lower portion of the blind illustrating my preferred methods of shortening the blind.
Figure 8B:
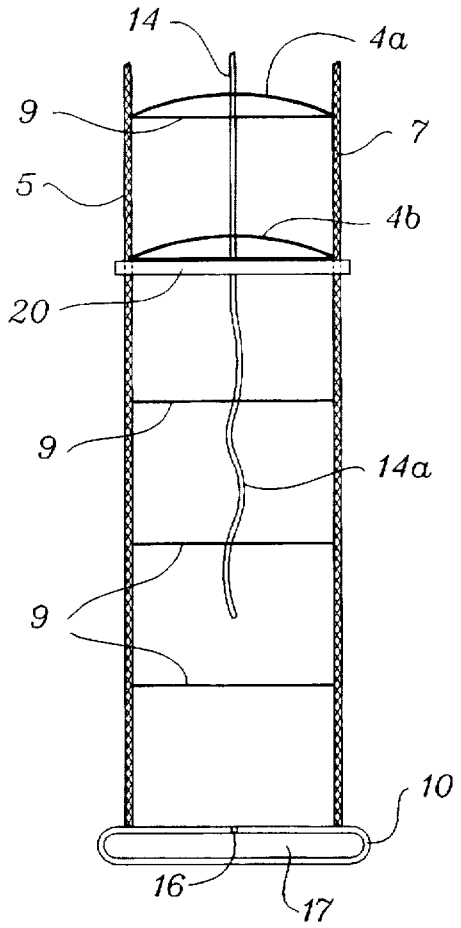
Figure 8C:
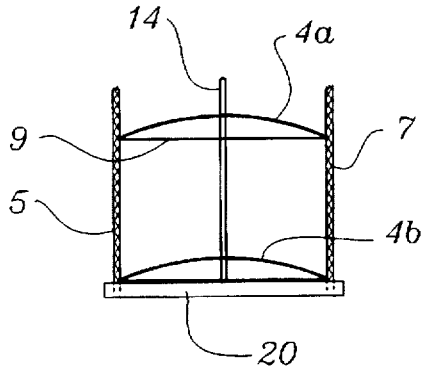
Figure 8D:
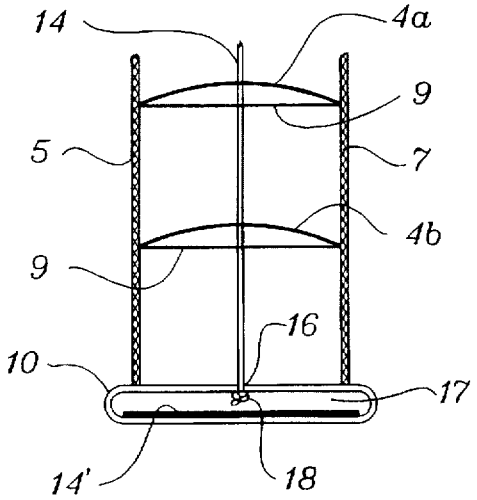

Referring now to FIGS. 8*a* through 8*d*, I also provide methods for customizing the length of the a venetian type blind 1 using the clamps described previously. The length of the window in which the blind is to be installed is measured and a standard length blind is initially selected. To create the best appearance, the fully extended length of the selected blind will be very close to the length of the window. Thus, a standard size blind having a length close to but longer than the window should be selected. To shorten the length of the blind to fit the length of the window, a slat 4*b* nearest the new length for the blind is identified. Two clamps 20 are attached to two of the ladders or lift cords below the selected slat as shown in FIGS. 1 and 2. At that point the installer has several options. First, he can cut the lift cord and ladder rails just below the clamp 20 to create the structure shown in FIG. 8*c*. Then he may consider the shortening process finished and install the shortened blind on a window. A second option is to attach the clamps 20 to the bottomrail. This can be done where the bottomrail has slots, a cavity or otherwise configured to receive the clamps. A third option is to detach the bottomrail from the lift cords and ladders. The lift cords 14 are disconnected from the bottomrail and pulled through the route holes in the slats 4*c*, 4*d* and 4*e* which are to be removed. At that point the lift cord 14 and clamp 20 will be as shown in FIG. 8*a*. This can be done by grasping the lift cord below the selected slat 4*b* and simply pulling the lift cord through the slats to be removed. This means that each cord must be pulled individually. If desired, a snivee or other stop device can be attached to the end of the lift cords. The snivee or other stop device will allow the lift cord to pass from the bottomrail through the excess slats. Then, the snivee or stop device is turned or otherwise changed in shape so as not to pass through route holes in the selected slat 46. Then, the lift cords can be pulled before the clamps are attached. At that point the lift cords are left to hang and slat 4*b* rests on the lift cords until clamps 20 are attached. Slats 4*c*, 4*d*, and 4*e* are removed after all of the lift cords 14 have been pulled so that the blind looks like that shown in FIG. 8*b*. The ladders are shortened and reattached to the bottomrail. This may be done by putting the excess portions of the ladders into a cavity in the bottomrail. Finally, each lift cord is inserted through hole 16 into the bottomrail and secured to the bottomrail such as by tying a knot in the cavity 17 as shown in FIG. 8*d*. If desired some or possibly all of the slats 14' that have been removed can be stored in the bottomrail, if the bottomrail is sized to receive those slats. Most likely this would only be done for blinds in which the lift cords are adjacent the edges of the slats rather than passing through route holes in the slats.

The bottomrail may be configured to have a cavity, such as cavity 17, in which the clamps can be stored. Thus, blinds of standard length could be sold with such clamps. When necessary the installer would have them immediately available to shorten the blind.

Figure 9:
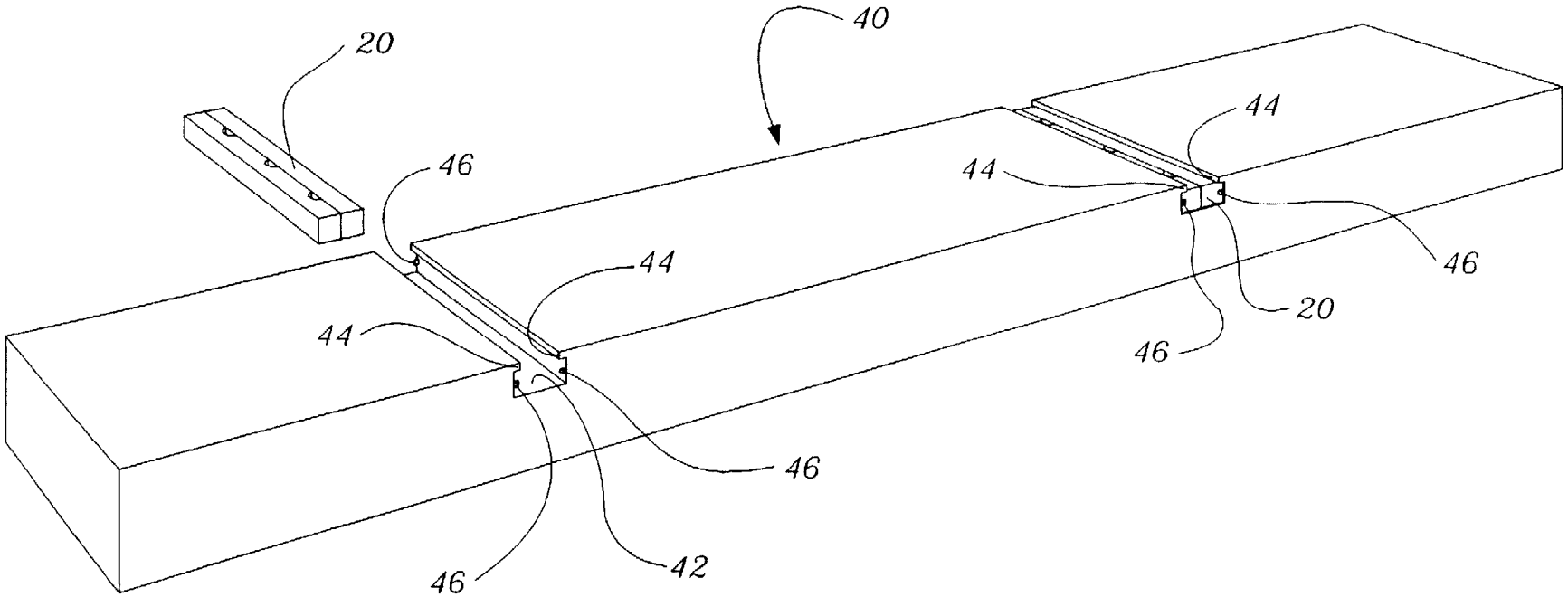
FIG. 9 is a perspective view of a present preferred bottomrail having channels to receive the clamps.
Figure 10:
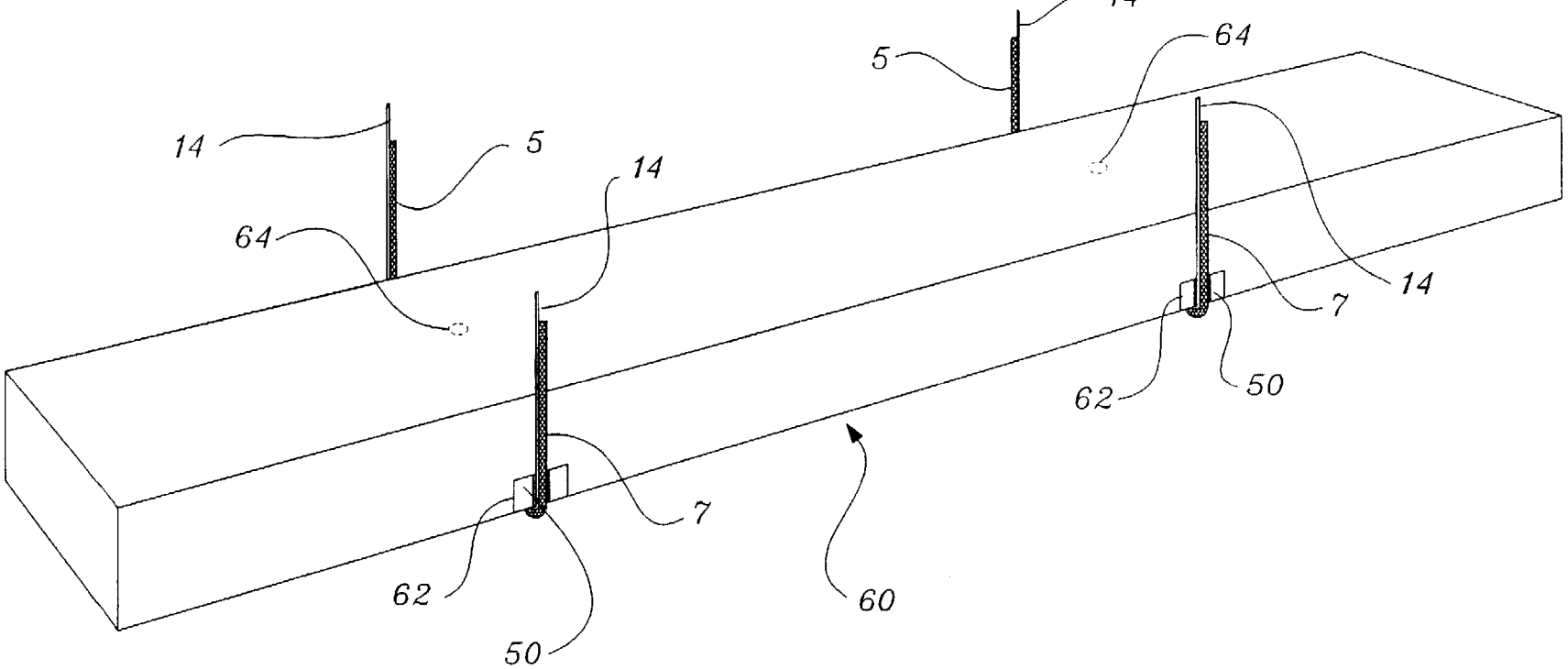
FIG. 10 is a perspective view of a second preferred bottomrail.

FIGS. 9 and 10 illustrate bottomrails to which the clamps can be attached. A simple configuration using a solid bottomrail 40 is shown in FIG. 9. In that bottomrail a transverse channel 42 is provided at each ladder location. The channel is sized to have parallel shoulders 44 which prevent upward movement of the clamp away from the bottomrail 40. Transverse movement is prevented by locking tabs 46 at either end of the channel. If desired one end of the channel could be closed. This type of bottomrail could be made wider than the slats so that he clamps extend beyond the slats when used for shortening the blind as shown in FIGS. 2, 8*a* and 8*b*. Another alternative is to make the slats and bottomrail of equal width. That would require squeezing the rails together when they are attached to the clamp. The bottomrail and clamps shown in FIG. 9 can be used for blinds having lift cord route holes through the slats or no holes blinds in which the lift cords are adjacent the edges of the slats.

A second bottomrail 60 that is primarily designed for no holes blinds is shown in FIG. 10. That bottomrail has channels 62 for each clamp 50. The ladder rails 5 and 7 and lift cords 14 which are adjacent the ladder rails fit around the outside of the bottomrail 60 and arc held in clamps 50. Preferably, each rail and adjacent lift cord are in the same slots 56 and 56' or 57 and 57' of each clamp. (See FIGS. 6 and 7). Each clamp 50 fits within a channel 62. The weight of the bottomrail 60 and any slats resting on the bottomrail compresses the bottomrail onto the clamps. Holes 64 shown in dotted line can be provided in the bottomrail 60 and clamps 50 to allow the bottomrail to be used for standard venetian blinds in which the lift cords pass through route holes in the slats. Then, each lift cord could be routed through a hole 64 and knotted or otherwise secured to the bottomrail. Although the embodiment is shown to use the clamp 50 of FIGS. 6 and 7, other types of clamps including the clamp shown in FIGS. 3, 4 and 5, could be used.

Although I have shown and described certain present preferred embodiments of my length adjustable clamps and method for adjusting the length of a venetian type blind, it should be distinctly understood that the invention is not limited thereto but may be variously embodied within the scope of the following claims.

I claim:

1. A method of adjusting a length of a venetian type blind of the type having a headrail, at least two ladders extending from the headrail which ladders have opposite rails and rungs extending therebetween, a plurality of slats resting on the rungs, and lift cords, each lift cord passing from the headrail adjacent a ladder and routed adjacent one edge of the slats or through a route hole in each slat, the method comprising:

a. selecting a blind having a length longer than a desired new length;

b. identifying a slat at the desired new length;

c. attaching a clamp to each of at least two ladders below and adjacent the identified slat; and d. removing that portion of the blind which is below the clamps.

2. The method of claim 1 also comprising the step of attaching a bottomrail to the clamps.

3. The method of claim 1 also comprising removing the clamps.

4. The method of claim 1 wherein the blind has a bottomrail attached to the ladders and the step of removing that portion of the blind which is below the clamps is comprised of:

a. passing each lift cord through the route holes of the slats that are positioned below the identified slat;

b. removing excess slats between the identified slat and the bottomrail to create a plurality of empty rungs;

e. detaching the ladders from the bottomrail;

f. shortening the ladders;

g. attaching the shortened ladders to the bottomrail; and i. attaching the lift cords to the bottomrail.

5. The method of claim 4 wherein the ladders are shortened by cutting portions of the ladders.

6. The method of claim 4 also comprising removing the clamps and storing the clamps in the bottomrail.

7. The method of claim 4 also comprising attaching the clamps to the bottomrail.

8. The method of claim 1 wherein the clamp is comprised of:

a. a body having a first elongated portion and a second elongated portion pivotably connected by a hinge and the first elongated portion having at least one transverse slot sized and positioned to receive a ladder rail or a lift cord such that when the first portion and the second portion are in a closed position the second portion will cover the at least one transverse slot; and b. a clasp attached to the body for retaining the first portion and the second portion in a closed position.

9. The method of claim 8 wherein the hinge is a living hinge and the body and clamps are molded as a single piece.

10. The method of claim 8 wherein the second elongated portion is a U-shaped wire member having a base and two ends, the U-shaped member attached to the first member by a hub attached to the first member and the base of the U-shaped member which hub functions as the hinge and wherein the first elongated portion is sized to receive the ends of the U-shaped wire member.

* * * * *